US006692341B2

(12) United States Patent
Kishida et al.

(10) Patent No.: US 6,692,341 B2
(45) Date of Patent: Feb. 17, 2004

(54) ABRASIVE MACHINE

(75) Inventors: Hiromi Kishida, Nagano (JP); Yoshio Nakamura, Nagano (JP); Susumu Onishi, Nagano (JP)

(73) Assignee: Fujikoshi Machinery Corp., Nagaono (JP)

( * ) Notice: Subject to any disclaimer, the term of this patent is extended or adjusted under 35 U.S.C. 154(b) by 99 days.

(21) Appl. No.: 10/136,578

(22) Filed: Apr. 25, 2002

(65) Prior Publication Data

US 2002/0160702 A1 Oct. 31, 2002

(30) Foreign Application Priority Data

Apr. 27, 2001 (JP) ..... 2001-131717

(51) Int. Cl.[7] ..... B24B 7/22

(52) U.S. Cl. ..... 451/259; 451/53; 451/449; 451/504

(58) Field of Search ..... 451/53, 285, 286, 451/287, 288, 289, 259, 290, 449, 340, 342, 343, 495, 504, 505, 548, 550

(56) References Cited

U.S. PATENT DOCUMENTS 6,024,631 A * 2/2000 Piper ..... 451/41
6,390,901 B1 * 5/2002 Hiyama et al. ..... 451/285
6,527,632 B1 * 3/2003 Dooley et al. ..... 451/504
6,575,816 B2 * 6/2003 Hempel et al. ..... 451/41
6,579,152 B1 * 6/2003 Kimura ..... 451/41

FOREIGN PATENT DOCUMENTS

JP 10-235552 9/1998
JP 11-307486 11/1999

* cited by examiner

*Primary Examiner*—Timothy V. Eley
(74) *Attorney, Agent, or Firm*—Jordan and Hamburg LLP

(57) ABSTRACT

The abrasive machine of the present invention is capable of controlling a shape of an abrasive face of a small abrasive plate. The abrasive machine comprises: a plate holder holding an abrasive plate; a fixed engaging member being fixed to the plate holder and engaging with the abrasive plate; a first O-ring being provided between the fixed engaging member and the abrasive plate; a second O-ring being provided between the plate holder and the abrasive plate; and a fluid supply-discharge mechanism for supplying a fluid to and discharging the same from a zone enclosed by the abrasive plate, the plate holder and the second O-ring. An outer circumferential face of the abrasive plate is separated from an inner circumferential face of the fixed engaging member.

5 Claims, 4 Drawing Sheets

ABRASIVE MACHINE

BACKGROUND OF THE INVENTION

The present invention relates to an abrasive machine, more precisely relates to an abrasive machine capable of controlling a shape of an abrasive face of an abrasive plate so as to precisely abrade work pieces.

Abrasive machines have been widely used to abrade, polish or lap work pieces, e.g., semiconductor wafers, glass, crystals. A conventional abrasive machine is shown in FIG. 5. An abrasive plate 12 is held by a plate holder 14, and the holder plate 14 is provided on a base 50. The abrasive plate 12 is fixed to the plate holder 14 by bolts. The plate holder 14 is rotatably supported by a bearing 52, so that the plate holder 14 holding the abrasive plate 12 is capable of rotating with respect to the base 50. A rotary shaft 18 is fixed to the plate holder 14 and connected to a driving mechanism, e.g., a motor. The driving mechanism rotates the plate holder 14 together with the abrasive plate 12. An upper face (an abrasive face) of the abrasive plate 12 is covered with abrasive cloth 13 so as to polish work pieces.

A holding unit 30 holds and presses the work pieces, e.g., semiconductor wafers, onto the abrasive plate 12. The work pieces are sucked and held on a bottom face of a sucking board 32 of the holding unit 30. By rotating the holding unit 30 and the abrasive plate 12, the work pieces can be polished. Slurry is supplied to the abrasive cloth 13 from a nozzle 34.

Note that, a symbol 10 stands for an abrasive unit including the abrasive plate 12, the abrasive cloth 13 and the plate holder 14.

To make surfaces of the work pieces highly flat, flatness of the abrasive face of the abrasive plate 12 must be high. In some cases, the abrasive face of the abrasive plate 12 is slightly projected or depressed according to work pieces. To improve the flatness of the abrasive face of the abrasive plate, accuracy of machining the abrasive plate is made higher, thickness of the abrasive plate is made thicker, or the abrasive plate is made of a tough material. On the other hand, the abrasive face of the abrasive plate is projected or depressed by adjusting pressure of water for cooling the abrasive plate.

Frictional heat is generated between the abrasive face of the abrasive plate and the work pieces, so that the abrasive plate is expanded by the frictional heat. To prevent the heat expansion of the abrasive plate, the cooling water is introduced into water paths between the abrasive plate and the plate holder. For example, Japanese Patent Gazette No. 10-235552 disclosed a polishing machine in which an abrasive face of an abrasive plate is projected by adjusting pressure of cooling water running through water paths between the abrasive plate and a plate holder. Japanese Patent Gazette No. 11-307486 disclosed an abrasive machine in which a shape of an abrasive face is controlled projected by adjusting pressure of cooling water running through tubes between an abrasive plate and a plate holder.

FIG. 6 shows water paths 40 formed in an upper face of the plate holder 14. An inlet 45 of cooling water is formed at a center of the plate holder 14. The upper face of the plate holder 14 is divided into six sectors, and a zigzag water path 40 is formed in each of the sectors. An outlet 46 of the cooling water is formed in each of the sectors. The outlets 46 are located close to the inlet 45. The cooling water runs from the center to an outer edge part of the plate holder 14, then returns to the center thereof via the water paths 40. The cooling water returned to the center is discharged from the outlets 46.

FIG. 7 shows a sectional view of the abrasive unit 10. A water path 42 for supplying the cooling water and a water path 44 for discharging the cooling water are formed in the rotary shaft 18. The water paths 42 and 44 are connected to a water supply-discharge mechanism (not shown) via a distributor (not shown).

In FIG. 7, the water paths 40 are formed between the abrasive plate 12 and the plate holder 14.

In FIG. 7, the water paths 40 are formed between the abrasive plate 12 and the plate holder 14, so the shape of the abrasive face of the abrasive plate 12 can be controlled by controlling pressure of the cooling water running through the water paths 40. However, in the case of a small abrasive plate whose outer diameter is about 50 cm, the abrasive face is hardly deformed, so it is difficult to control the shape of the abrasive face by controlling the pressure of the cooling water. In the conventional abrasive unit 10 shown in FIG. 7, the abrasive plate 12 and the plate holder 14 are integrated other than the water paths 40, so it is difficult to deform the abrasive plate 12.

In the polishing machine disclosed in the Japanese Patent Gazette No. 10-235552, the cooling water runs between whole faces of the abrasive plate and the plate holder, but an outer edge of the abrasive plate is fixed to the plate holder. With this structure, the abrasive plate is hardly deformed.

SUMMARY OF THE INVENTION

The present invention is capable of solving the above described disadvantages of the conventional abrasive machines.

An object of the present invention is to provide an abrasive machine capable of controlling a shape of an abrasive face of a small abrasive plate so as to precisely abrade work pieces.

To achieve the object, the abrasive machine of the present invention comprises:

an abrasive plate;

a plate holder holding the abrasive plate;

a fixed engaging member being formed into a ring shape and fixed to the plate holder, the fixed engaging member engaging with an outer edge of the abrasive plate;

a first O-ring being provided between a pressing face of the fixed engaging member and an upper face of the abrasive plate, the first O-ring separating the pressing face of the fixed engaging member from the upper face of the abrasive plate;

a second O-ring being provided between an upper face of the plate holder and a lower face of the abrasive plate, the second O-ring separating the upper face of the plate holder from the lower face of the abrasive plate; and a fluid supply-discharge mechanism for supplying a fluid to and discharging the same from a zone enclosed by the lower face of the abrasive plate, the upper face of the plate holder and the second O-ring, the fluid supply-discharge mechanism changing a shape of an abrasive face of the abrasive plate by changing pressure of the fluid, wherein an outer circumferential face of the abrasive plate is separated from an inner circumferential face of the fixed engaging member.

In the abrasive machine of the present invention, the abrasive plate is held by the plate holder with the first and the second O-rings, which are respectively provided on the both sides of the abrasive plate. With this structure, the abrasive plate can be easily deformed, so that the shape of the abrasive face can be easily controlled by adjusting pressure of a fluid for cooling the abrasive plate. Further, the zone between the abrasive plate and the plate holder is tightly closed by the O-rings, so the fluid supplied by the fluid supply-discharge mechanism can be securely held in the zone.

In the abrasive machine, a position of the first O-ring in the upper face of the abrasive plate may correspond to that of the second O-ring in the lower face thereof. With this structure, the abrasive plate can be easily deformed, so that the shape of the abrasive face can be easily controlled.

In the abrasive machine, the fixed engaging member may include:

a fixed section being fixed to the plate holder; and an extended section being inwardly extended from the inner circumferential face of the fixed engaging member and covering the outer edge of the abrasive plate.

In the abrasive machine, a step section may be formed in the outer edge of the abrasive plate, and the step section may be held by the extended section of the fixed engaging member.

In the abrasive machine, the abrasive plate may be made of a ceramic. By employing the ceramic abrasive plate, heat deformation of the abrasive plate can be prevented, and the shape of the abrasive face can be precisely controlled by adjusting pressure of a fluid for cooling the abrasive plate.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
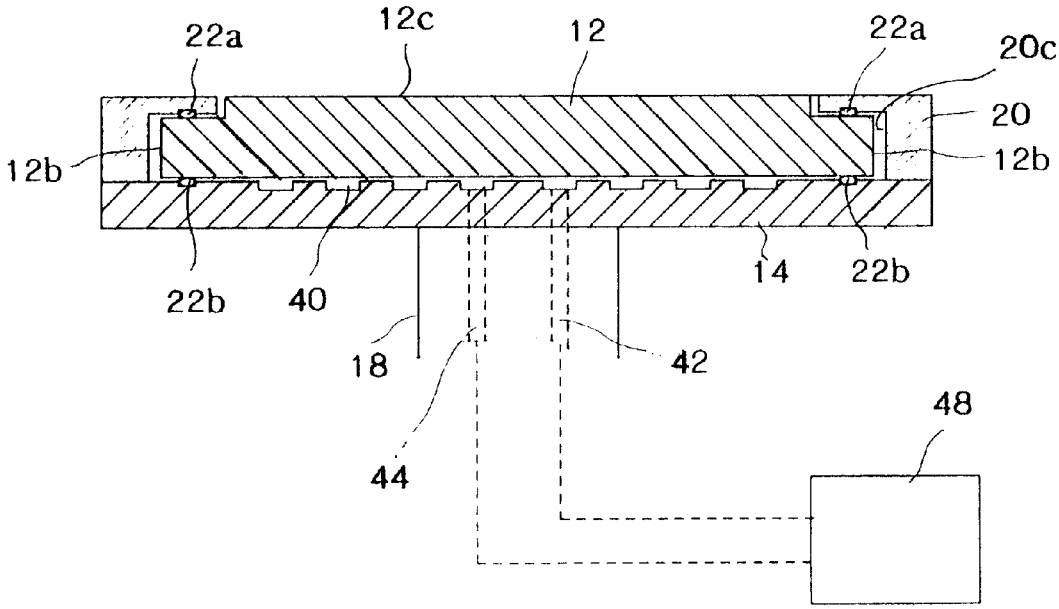
FIG. 1 is a sectional view of an abrasive plate and a plate holder of an abrasive machine of an embodiment of the present invention.
Figure 5:
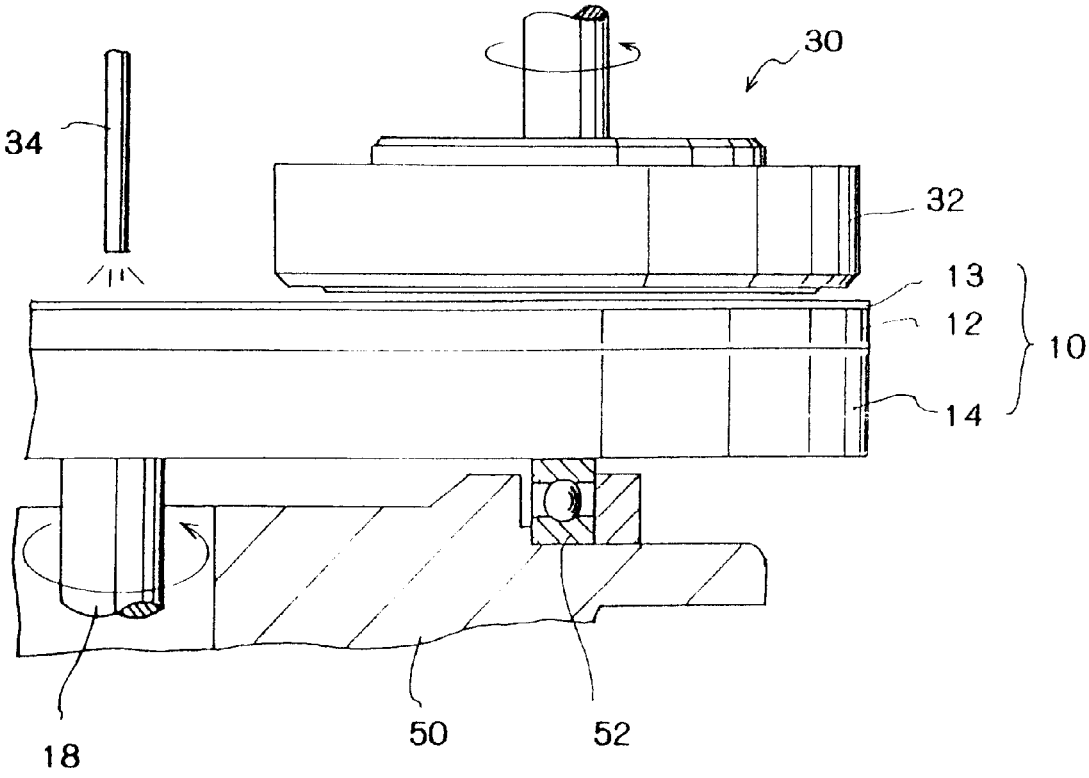
FIG.5 PRIOR ART
FIG. 5 is an explanation view of the conventional abrasive machine.
Figure 6:
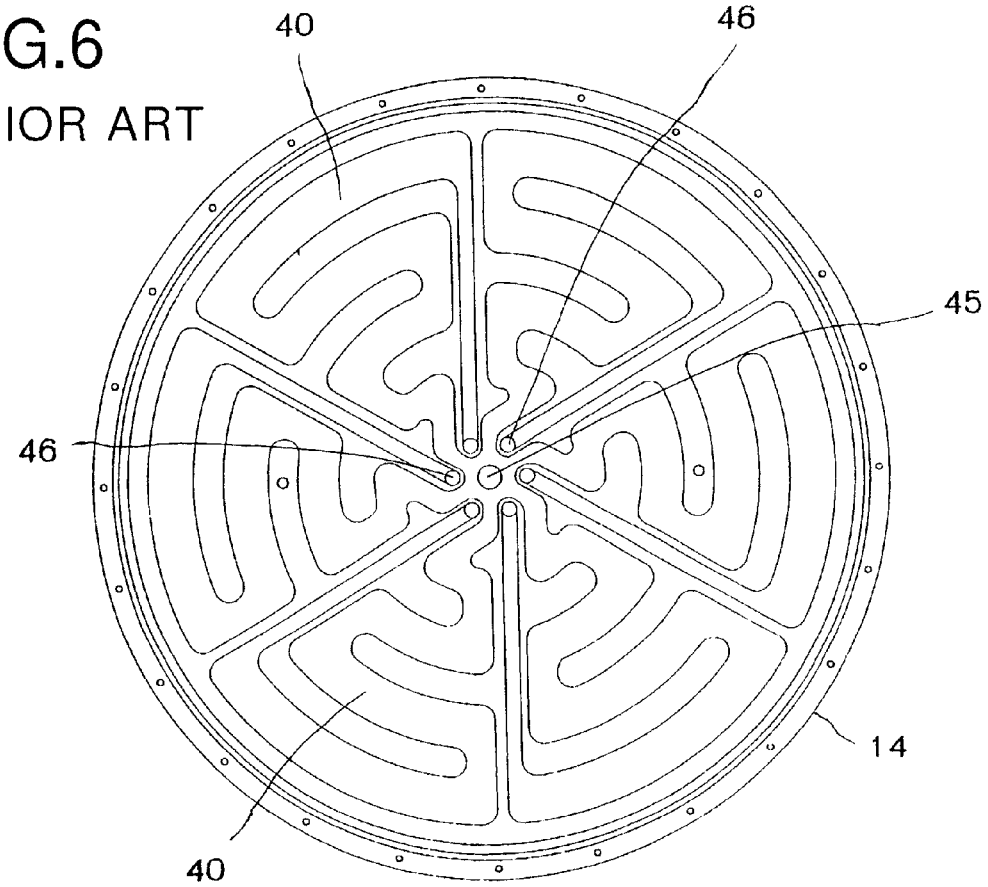
FIG.6 PRIOR ART
FIG. 6 is a plan view of the conventional plate holder.
Figure 7:
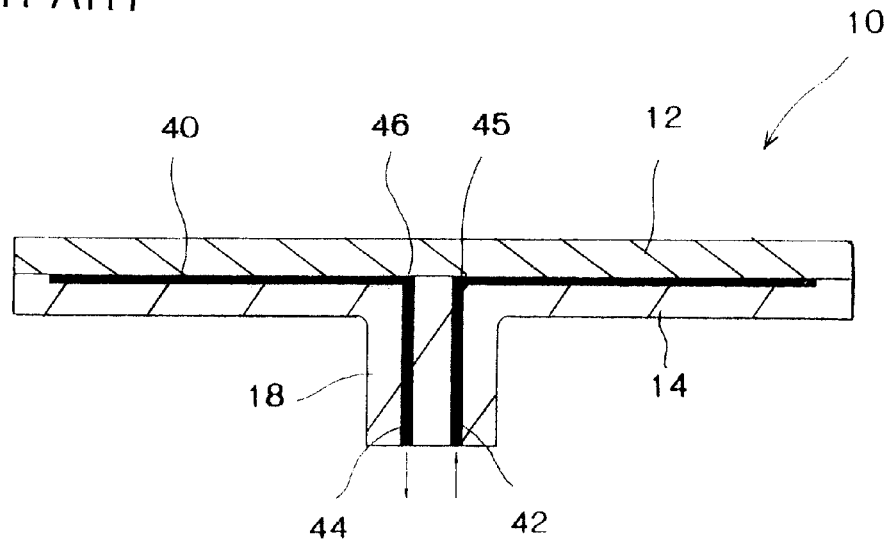
FIG.7 PRIOR ART
FIG. 7 is a sectional view of the conventional abrasive plate and the conventional plate holder.

FIG. 1 is a sectional view of an abrasive plate 12 and a plate holder 14 of an abrasive machine of the present embodiment. The abrasive machine of the present embodiment also has a driving mechanism (not shown) for rotating the plate holder 14 together with the abrasive plate 12 and a holding unit (not shown) for holding work pieces, e.g., semiconductor wafers, as well as the conventional abrasive machine. Further, a mechanism for holding the abrasive plate may be applied to not only the polishing machine for polishing one side of a work piece (see FIG. 5) but also a polishing machine for polishing both sides of a work piece, a lapping machine, etc.

In FIG. 1, the abrasive plate 12 is formed into a circular disk and made of an alumina ceramic. An outer diameter of the abrasive plate 12 is 504 mm; thickness thereof is 20 mm. In the conventional abrasive machine, the whole lower face of the abrasive plate is fixed on the plate holder by bolts. On the other hand, in the present embodiment, a fixed engaging member 20 is fixed to an outer edge of the plate holder 14, and an outer edge of the abrasive plate 12 is engaged with the fixed engaging member 20, so that the abrasive plate 12 is held on the plate holder 14.

Figure 4:
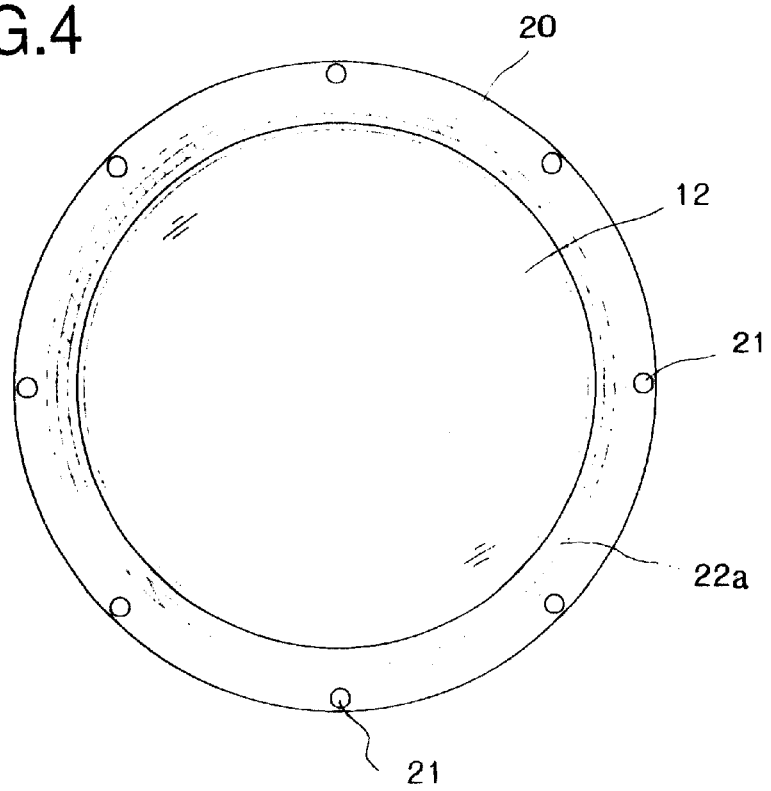
FIG. 4 is a plan view of the abrasive plate engaged with the fixed engaging member.

FIG. 4 is a plan view of the abrasive plate 12 held by the fixed engaging member 20. The whole outer edge of the abrasive plate 12 is engaged with the fixed engaging member 20. The fixed engaging member 20 is formed into a ring-shape and capable of engaging with fixed width. The fixed engaging member 20 is fixed to the plate holder 14 by bolts 21. By fixing the engaging member 20 to the plate holder 14, the outer edge of the abrasive plate 12 is vertically clamped between the fixed engaging member 20 and the plate holder 14, so that the abrasive plate 12 is held by the plate holder 14.

Figure 3:
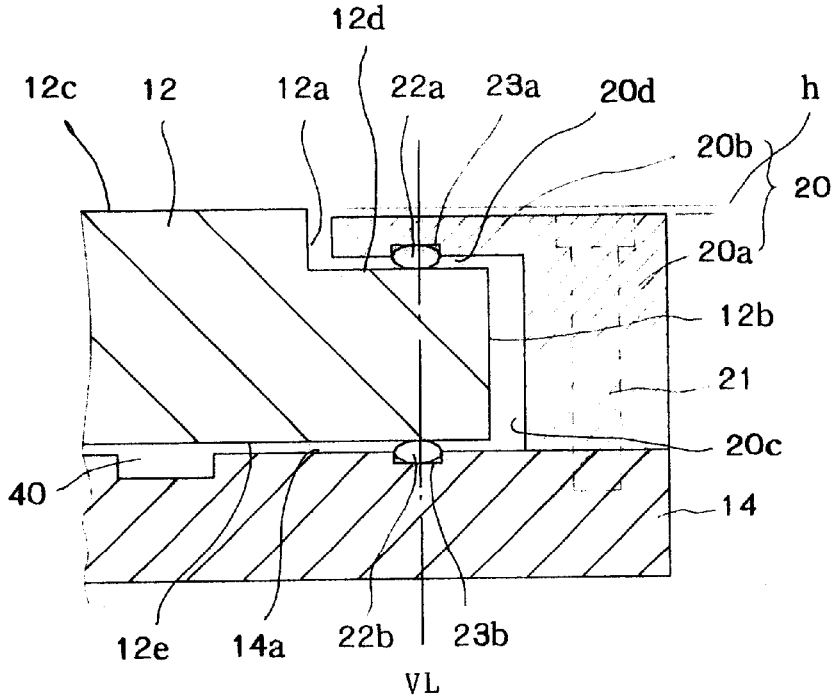
FIG. 3 is a partial sectional view of a fixed engaging member engaging with the abrasive plate.

FIG. 3 is a partial enlarged sectional view of the fixed engaging member 20 holding the abrasive plate 12 on the plate holder 14. A sectional shape of the fixed engaging member 20 is an L-shape. Namely, the fixed engaging member 20 includes: a fixed section 20*a* vertically fixed to the plate holder 14; and an extended section 20*b* inwardly extended from an inner circumferential face 20*c* of the fixed engaging member 20. The extended section 20*b* covers the outer edge of the abrasive plate 12. A circular groove 23*a* is formed in a lower face 20*d* of the extended section 20*b*, which faces an upper face 12*d* of the abrasive plate 12. A first O-ring 22*a* is fitted in the circular groove 23*a*. A lower part of the first O-ring 22*a* is downwardly projected from the lower face 20*d* of the extended section 20*b*.

A circular step section 12*a* is formed along the upper edge section of the abrasive plate 12. The outermost part of the upper face 12*d* is lower than other parts. The outermost part of the upper face 12*d* is covered with the extended section 20*b* of the fixed engaging member 20. In the present embodiment, level difference "h" between the abrasive face 12*c* of the abrasive plate 12 and an upper face of the fixed engaging member 20 is about 2 mm in the state of engaging the abrasive plate 12 with the fixed engaging member 20.

In FIG. 3, a circular groove 23*b* is formed in an upper face 14*a* of the plate holder 14. The second O-ring 22*b* is fitted in the circular groove 23*b*. An upper part of the second O-ring 22*b* is upwardly projected from the upper face 14*a* of the plate holder 14.

In the present embodiment, a position of the first O-ring 22*a* on the upper face 12*d* of the abrasive plate 12 corresponds to that of the second O-ring 22*b* on the lower face thereof. Namely, a contact positions of the first and the second O-rings 22*a* and 22*b* are provided on a vertical line "VL". With this structure, the upper face and the lower face of the abrasive plate 12 is supported at the same positions.

Since the lower part of the first O-ring 22*a* and the upper part of the second O-ring 22*b* are respectively projected from the lower face 20*d* of the extended section 20 and the upper face 14*a* of the plate holder 14, the abrasive plate 12 is clamped by the O-rings 22*a* and 22*b* without contacting the faces 20*d* and 14*a*.

An outer circumferential face 12*b* of the abrasive face 12 is separated from an inner circumferential faced 20*c* of the fixed engaging member 20. Namely, as shown in FIG. 1, the abrasive plate 12 is clamped and held by the O-rings 22*a* and 22*b*, and the outer circumferential face 12*b* of the abrasive face 12 is separated from the inner circumferential faced 20*c* of the fixed engaging member 20. In the present embodiment, only the O-rings 22*a* and 22*b* contact the abrasive plate 12.

When the abrasive plate 12 is attached to the plate holder 14, firstly the second O-ring 22*b* is fitted in the circular groove 23*b* of the plate holder 14, and the abrasive plate 12 is mounted onto the plate holder 14. On the other hand, the first O-ring 22*a* is fitted in the circular groove 23*a* of the fixed engaging member 20. Then, the fixed engaging member 20 is attached to the plate holder 14 with adjusting the position. Finally, the fixed engaging member 20 is fixed to the plate holder 14 by bolts 21.

When the abrasive plate 12 is mounted onto the plate holder 14, the position of the abrasive plate 12 is adjusted so as to separate the outer circumferential face 12*b* of the abrasive face 12 from the inner circumferential faced 20*c* of the fixed engaging member 20.

By holding the abrasive plate 12 as shown in FIG. 1, only the O-rings 22*a* and 22*b* contact the upper face and the lower face of the abrasive plate 12.

As shown in FIG. 1, fluid paths 40 are grooves formed in the upper face of the plate holder 14. In the present embodiment, a zone including the fluid paths 40 is enclosed by the lower face of the abrasive plate 12, the upper face of the plate holder 14 and the O-rings 22*a* and 22*b*, so a fluid, e.g., cooling water, is introduced into the zone. The fluid can easily flow in the fluid paths 40, but fluid pressure is uniformly applied in the zone. Therefore, the fluid paths 40 may be omitted.

Since the second O-ring 22*b* is provided between the abrasive plate 12 and the plate holder 14, the zone is securely sealed from outside, and the fluid pressure in the zone can be maintained.

A rotary shaft 18 rotatably supports the plate holder 14 and the abrasive plate 12. A water path 42 for supplying the cooling water and a water path 44 for discharging the cooling water are formed in the rotary shaft 18. The water paths 42 and 44 are connected to a water supply-discharge mechanism 48, which supplies and discharges the cooling water. With this structure, the water supply-discharge mechanism 48 is communicated to the zone enclosed by the abrasive plate 12, the plate holder 14 and the second O-ring 22*b*, the water supply-discharge mechanism 48 is capable of adjusting the water pressure (the fluid pressure) in the zone.

In FIG. 1, the water supply-discharge mechanism 48 supplies the cooling water to and discharges the same from the zone. The water pressure in the zone is 0 kPa. Since the water pressure is not applied, the abrasive face 12*c* of the abrasive plate 12 is slightly depressed. In the present embodiment, depth of the depression at the center of the abrasive face 12*c* with respect to the outer edge thereof is 70 $\mu$m.

On the other hand, in the case of increasing the water pressure in the zone until 100 kPa, the abrasive face 12*c* of the abrasive plate 12 is slightly projected. In the present embodiment, height of the projection at the center of the abrasive face 12*c* with respect to the outer edge thereof is 10 $\mu$m.

Figure 2:
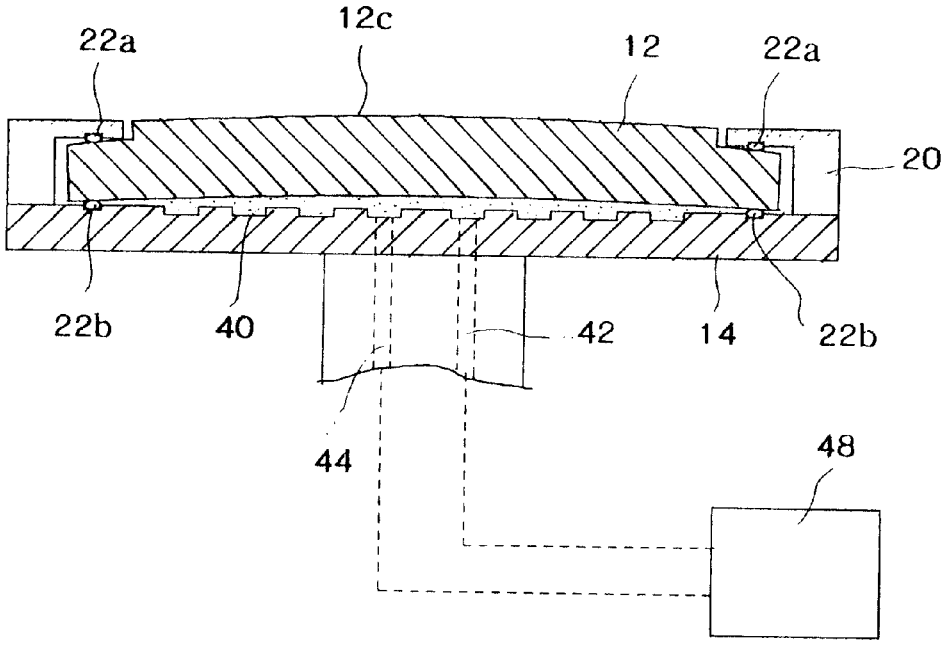
FIG. 2 is a sectional view of the abrasive plate whose abrasive face is projected upward.

In FIG. 2, the water pressure in the zone enclosed by the abrasive plate 12, the plate holder 14 and the second O-ring 22*b* is increased. By increasing the water pressure in the zone, the abrasive plate 12 is upwardly warped, so that the abrasive face 12*c* is upwardly projected.

As described above, the abrasive plate 12 is made of the ceramic. Therefore, the shape of the abrasive face 12*c* of the abrasive plate 12 can be controlled by adjusting the water pressure in the zone.

In the present embodiment, the abrasive plate 12 is the small abrasive plate whose outer diameter is 504 mm. Conventionally, it is difficult to deform the small abrasive plate by adjusting the pressure of the cooling water. In the present embodiment, only the O-rings 22*a* and 22*b* contact the upper face 12*d* and the lower face 12*e* the small abrasive plate 12, and the outer circumferential face 12*b* of the abrasive plate 12 is separated from the fixed engaging member 20, the shape of the abrasive face 12 of the small abrasive plate 12 can be effectively controlled.

The second O-ring 22*b* water-tightly seals the zone, in which the cooling water is supplied, and clamps the abrasive plate with the first O-ring 22*a*. Since the O-rings 22*a* and 22*b* clamping the abrasive plate 12 are made of an elastic material, the abrasive plate 12 is elastically held by the O-rings 22*a* and 22*b*. As described above, only the O-rings 22*a* and 22*b* contact the abrasive plate 12, so that the O-rings 22*a* and 22*b* work as fulcrum points. Therefore, the abrasive plate 12 can be easily deformed. Further, the abrasive plate 12 is elastically held by the O-rings 22*a* and 22*b*, so the abrasive plate 12 can be easily deformed.

The O-rings 22*a* and 22*b* are arranged along the outer edge of the abrasive plate 12, and the zone enclosed by the abrasive plate 12, the plate holder 14 and the O-ring 22*b* is the closed one space. With this structure, the abrasive face 12*c* of the abrasive plate 12 can be symmetrically projected or depressed with respect to the center by adjusting the water pressure in the zone.

In the present embodiment, the abrasive plate 12 is held by the O-rings 22*a* and 22*b* only, and the pressure of the cooling water in the zone is adjusted. Therefore, the shape of the abrasive face 12*c* of the abrasive plate 12 can be controlled. In the abrasive machine of the present embodiment, the work pieces held by the holding unit 30 are pressed onto the abrasive plate 12 as well as the conventional machine shown in FIG. 5. Pressing force of the holding unit 30, which is applied to the abrasive plate 12, is about 30 kPa, so it is much smaller than the pressure of the cooling water in the zone. Namely, the pressing force of the holding unit 30 does not badly influence the deformation of the abrasive plate 12.

In the above described embodiment, the abrasive plate 12 is made of the ceramic, but the abrasive plate of the present invention is not limited to ceramics. But, in the case of using the ceramic abrasive plate, heat deformation and heat expansion of the abrasive plate are not occurred by frictional heat between the work pieces and the abrasive cloth of the abrasive plate.

The shape of the abrasive face of the abrasive plate may be controlled, by adjusting the fluid pressure in the zone, with detecting the shape of the abrasive face by a sensor.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. An abrasive machine, comprising:

an abrasive plate;

a plate holder holding said abrasive plate;

a fixed engaging member being formed into a ring shape and fixed to said plate holder, said fixed engaging member engaging with an outer edge of said abrasive plate;

a first O-ring being provided between a pressing face of said fixed engaging member and an upper face of said abrasive plate, said first O-ring separating the pressing face of said fixed engaging member from the upper face of said abrasive plate;

a second O-ring being provided between an upper face of said plate holder and a lower face of said abrasive plate, said second O-ring separating the upper face of said plate holder from the lower face of said abrasive plate; and a fluid supply-discharge mechanism for supplying a fluid to and discharging the same from a zone enclosed by the lower face of said abrasive plate, the upper face of said plate holder and said second O-ring, said fluid supply-discharge mechanism changing a shape of an abrasive face of said abrasive plate by changing pressure of the fluid, wherein an outer circumferential face of said abrasive plate is separated from an inner circumferential face of said fixed engaging member.

2. The abrasive machine according to claim 1, wherein a position of said first O-ring in the upper face of said abrasive plate corresponds to that of said second O-ring in the lower face thereof.

3. The abrasive machine according to claim 1, wherein said fixed engaging member includes:

a fixed section being fixed to said plate holder; and an extended section being inwardly extended from the inner circumferential face of said fixed engaging member and covering the outer edge of said abrasive plate.

4. The abrasive machine according to claim 3, wherein a step section is formed in the outer edge of said abrasive plate, and the step section is held by the extended section of said fixed engaging member.

5. The abrasive machine according to claim 1, wherein said abrasive plate is made of a ceramic.

* * * * *